US005309806A

United States Patent [19]

Stavash

[11] Patent Number: 5,309,806

[45] Date of Patent: May 10, 1994

[54] WOODWIND MUSICAL INSTRUMENT

[76] Inventor: John C. Stavash, 21211 Kenwood Ave., Rocky River, Ohio 44116

[21] Appl. No.: 783,534

[22] Filed: Oct. 28, 1991

[51] Int. Cl.[5] ..... G10D 7/04

[52] U.S. Cl. ..... 84/380 R

[58] Field of Search ..... 84/380 R, 384, 380 C, 84/330

[56] References Cited

U.S. PATENT DOCUMENTS

| | | | |
|---|---|---|---|
| D. 139,332 | 10/1944 | Thompson | D56/1 |
| D. 139,333 | 10/1944 | Thompson | D56/1 |
| D. 146,547 | 4/1957 | Thompson | D56/1 |
| 1,119,954 | 12/1914 | Haynes . | |
| 2,602,364 | 7/1952 | Loney | 84/382 |
| 3,161,102 | 12/1964 | DeLancie | 84/380 |
| 3,191,481 | 6/1965 | Miller | 84/380 |
| 3,722,348 | 3/1973 | Visser | 84/380 |
| 3,776,090 | 12/1973 | Ihara | 84/380 |
| 3,783,732 | 1/1974 | Ihara | 84/385 |
| 4,104,948 | 8/1978 | Young | 84/380 C |
| 4,178,829 | 12/1979 | Wolford | 84/386 |
| 4,306,484 | 12/1981 | Toyama | 84/380 R |
| 4,515,060 | 5/1985 | Ferron | 84/380 |
| 4,714,001 | 12/1987 | Kergomard | 84/386 |

OTHER PUBLICATIONS

"The Physics of Wood Winds" Benade, Arthur H. Oct. 1960 pp. 35–43.

"On Woodwind Instrument Bores." A. H. Benade. *Jour. Acoust. Soc. of America* vol. 31, No. 2 pp. 137–146 Feb. 1959.

"Sound Production in Wind Instruments" A. H. Benade et al. *Annals of the N.Y. Acad. of Sciences* vol. 155 pp. 247–263 Nov. 20, 1968.

*Primary Examiner*—William M. Shoop, Jr.
*Assistant Examiner*—Jeffrey W. Donels
*Attorney, Agent, or Firm*—Lightbody & Harmon

[57] ABSTRACT

Modifications are made to the bore and to one tone hole of the instrument marketed as the Flutophone$^R$. These modifications greatly improve the intonation and extend the range of that instrument by enabling the production of a series of harmonic intervals which are not parallel to the ascending pitches of the fundamental scale.

6 Claims, 3 Drawing Sheets

WOODWIND MUSICAL INSTRUMENT

FIELD OF THE INVENTION

This invention relates to improvements in fipple flutes. In particular, it pertains to modifications made to the bore and to one tone hole of the instrument marketed as the Flutophone$^R$. These modifications greatly improve the intonation and extend the range of that instrument by enabling the production of a series of harmonic intervals which are not parallel to the ascending pitches of the fundamental scale. This use of harmonics is unique and is contrary to conventional instrument construction practice.

BACKGROUND OF THE INVENTION

Among the classes of woodwind instruments are those known as fipple flutes, or whistle flutes, in which sound is produced by blowing air through a windway against a lip which is a relatively sharp edge. This air stream oscillates across the lip and functions with the elasticity of the air in the bore of the instrument to change internal pressures in the bore. Finger holes in the body are closed or opened to alter the pitch by changing the length of the vibrating column of air.

Whistle flutes have been used for centuries as folk instruments and presently, because of their simplicity, are being used extensively in school music education.

Whistle flutes are made in many bore configurations. The most common are the following:

The recorder is a sophisticated instrument with an extended range. Chromaticism is achieved with a somewhat complex fingering pattern. The sound lacks sonority and the production of sound requires sensitive control. The bore is conical-cylindrical.

The penny whistle is a folk instrument with a two octave diatonic scale. It has little easily usable chromaticism. The bore is ordinarily cylindrical, but may be conical.

The ocarina bore whistle flute is sometimes described as "Globular". This type of instrument has been and presently is being used in music education in spite of its faulty intonation, woefully out of tune chromaticism and limited range. The unmodified Flutophone$^R$, for example, when tuned to A-440 has notes more than a semitone sharp.

These types of instruments are easy to blow and have simple, linear fingering patterns. Their use in music education is a reluctant compromise since ear training is an important part of music education. Pitch memory and the recognition of pitch-interval relationships are best developed if they are not contaminated by the cacophonic out of tune playing which is typical of beginning ensembles using faulty, out of tune instruments.

SUMMARY OF THE INVENTION

Obviously, a great need for improving these instruments has existed. I have made my invention to supply this need. I produced this invention by modifying the existing ocarina type whistle flute marketed under the name "Flutophone$^R$". This modification consisted essentially of a cylindrical step reduction in the bore at the large end, a conical extension of the bore at the small end, and the elimination of the smaller hole of the double finger hole.

My invention provides an inexpensive instrument for music education that is easy for small children to blow, hold, and finger. This instrument has simplicity and linearity in its fingering patterns. It has sonority of sound and ease of sound production over its entire range of an octave plus a fifth. It can be played in tune easily to a standard approaching that which is set for a professional orchestral instrument. It has sufficient chromaticism to play a wide range of literature. The musical potential of this instrument will allow its use in upper grade music appreciation classes. A "hands on" approach to the study of thematic material from the great literature will be a welcome change from the soporific effect of listening to recorded music.

Accordingly, it is an object of my invention to provide an improved musical instrument with an extended range.

It is a further object of this invention to provide an economical musical instrument.

It is another object of this invention to provide a sturdy enough musical instrument for use in primary education.

It is yet a further object of this invention to provide an easy to play musical instrument.

It is an especially important object of this invention to provide a musical instrument with good intonation so that the development of children's musical ears will not be harmed.

Other objects and a more complete understanding of the invention may be had by referring to the following description and drawings in which:

DESCRIPTION OF THE PREFERRED EMBODIMENT

Figure 1:
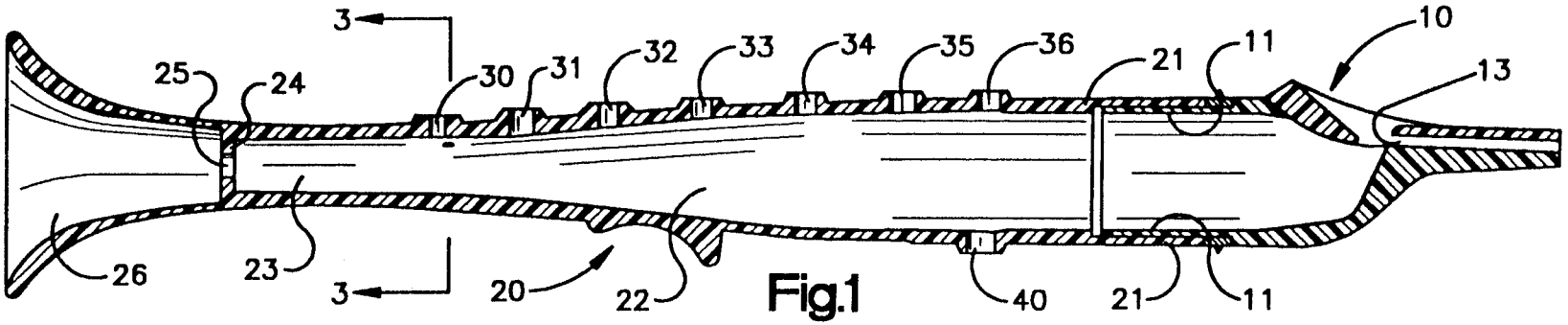
FIG. 1 shows the previous instrument, the Flutophone$^R$, in cross section.
Figure 2:
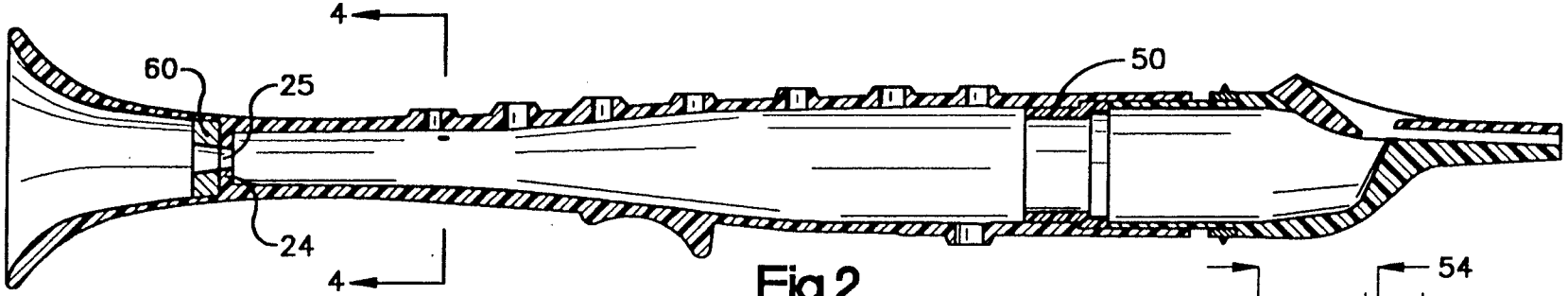
FIG. 2 shows the improvements of my invention, in cross section.

The unmodified instrument called the Flutophone$^R$ is shown, in section, in FIG. 1. It comprises a fipple head 10 with tenon 11 which is inserted into a body 20 at body socket 21. Body 20 has an ocarina bore 22 with a small end 23 on the other end from body socket 21. A web 24 separates the small end 23 of the ocarina bore 22 from a bell flare 26. Web 24 has a cylindrical web hole 25 at its center. Atop the center portion of ocarina bore 22 is a row of finger holes 30, 31, 32, 33, 34, 35, 36; on the bottom, approximately underneath finger hole 36, is a thumb hole 40.

Figure 3:
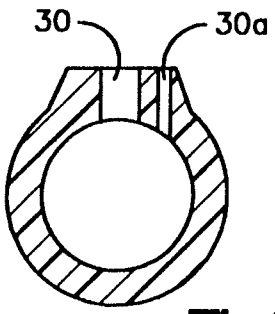
FIG. 3 is a cross sectional view taken through the lines 3—3 of FIG. 1.

FIG. 3 shows the Flutophone$^R$ in axial cross section, taken at plane 3—3 of FIG. 1. Another small hole is seen into the bore, the chromatic hole 30*a*. The same finger may cover either both holes 30 and 30*a*, or only hole 30*a*.

The Flutophone$^R$ is marketed by Trophy Products of Cleveland, Ohio and bears the expired design patent numbers U.S. Pat. Nos. Des. 139,332-139,333 and 146,547. Most of the claims of this application are intended to be limited to improvements on an instrument substantially similar in its bore to the Flutophone$^R$. By the term "ocarina bore whistle flute" in the claims is meant a woodwind instrument having substantially the same bore as a Flutophone$^R$, which is shown in FIG. 1.

The instrument as modified by my invention, which is named the Flautino, is shown, in section, in FIGS. 2, 4, 5, and 6.

Figure 6:
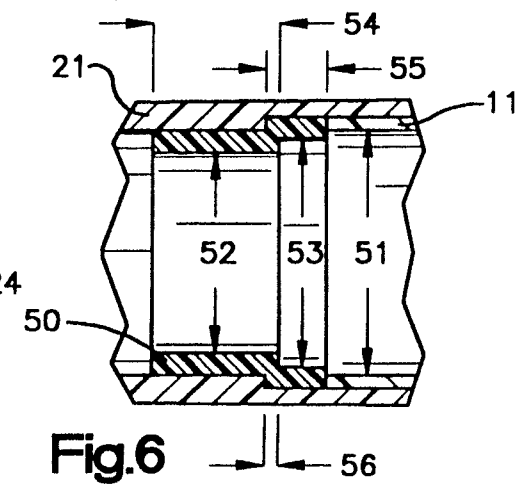
FIG. 6 is an enlarged cross sectional view of another portion of FIG. 2.
Figure 5:
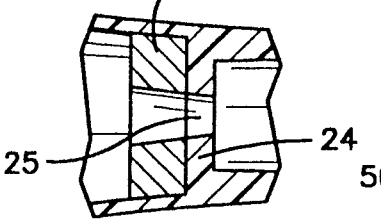
FIG. 5 is an enlarged cross sectional view of a portion of FIG. 2.
Figure 4:
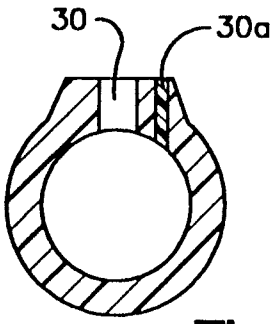
FIG. 4 is a cross sectional view taken through the lines 4—4 of FIG. 2.

Starting at the fipple end, the first modification, best shown in FIG. 6, comprises a reduction in the bore (i.e., the inside diameter) of fipple head tenon 11. The reduced bore is seen as 51. A second modification is the addition of a flanged insert 50 where tenon 11 is inserted into body socket 21. Insert 50 has an insert counterbore 53 which reduces the tenon bore 51, and an insert bore 52 which reduces the counterbore 53. It will also be seen that insert 50 has an insert flange, seen at 56, which locates the bore positions relative to the bottom of body socket 21. Fipple tenon 11 is inserted into body socket 21 so as to bottom against insert flange 54 in order to tune the instrument to A-440 at 68° F. The small end of ocarina bore 22 is extended through a thickened web 24 by a bore, preferably conical, opening into the existing remainder of the bell flare. As seen in FIG. 5, the thickening may be accomplished on an existing Flutophone$^R$ by adding a web insert 60 and enlarging the pre-existing web hole 25 to the shape of a truncated cone. Finally, chromatic hole 30*a* of FIG. 3 is eliminated as shown in FIG. 4 by filling it with any suitable substance such as grout.

Generally speaking, the first two modifications, made to the upper end of the bore, have as their primary effect the correction of intonation at the upper range, and the extension of that range by a phenomenon to be discussed hereunder. The second two modifications, that is, the thickening of web 24 and elimination of chromatic hole 30*a*, serve primarily to correct the Flutophone$^R$ grossly sharp intonation in its lower range. To a certain extent, these corrective effects are independent of each other, but it will immediately be recognized by those skilled in instrumental acoustics that all changes contribute somewhat to each effect, and that each should preferably be adjusted, to some extent, relative to the others to achieve the desired result.

It will be recognized that some of the described alterations will be accomplished in commercial production of the invention by dimensional and other changes in the dies rather than by inserts and filling.

In the presently preferred embodiment of the invention, the dimensions, seen best with reference to FIGS. 5 and 6, are as follows: The inside diameter (bore) of the tenon 11, shown as 51 in FIG. 6, is narrowed to 0.826" for a length of 1.0". The insert bore, shown as 52, is 0.687" for a length 54 of 0.375", and the insert counterbore, shown as 53, is 0.802' for a length 55 minus 56 of 0.187". The flange thickness, that is the axial distance 56 from a shoulder on the bore to a shoulder on the outside of the insert, is 0.187". The web insert 60 used to thicken web 24, which is shown best in FIG. 5, has a thickness (axial length) of 0.390", a taper with an included angle of 4°, and a minor inside diameter of 0.187". These dimensions were determined empirically and, of course, are subject to dimensional tolerances as will be known to those skilled in the art. In wind instrument design, these tolerances can be relatively large. The performer with varying degrees of musicianship and control may bend the pitch as desired to some extent to compensate for dimensional variations. For this reason and one other, only a set of preferred dimensions are given.

The one other reason is that the empirical approach used to realize the invention utilized crude materials such as cork, tape, and cements. The means of alteration will in practice be refined with machined components and those skilled in the art will adjust the dimensions accordingly.

Method and Results of Using the Invention

Figure 7:
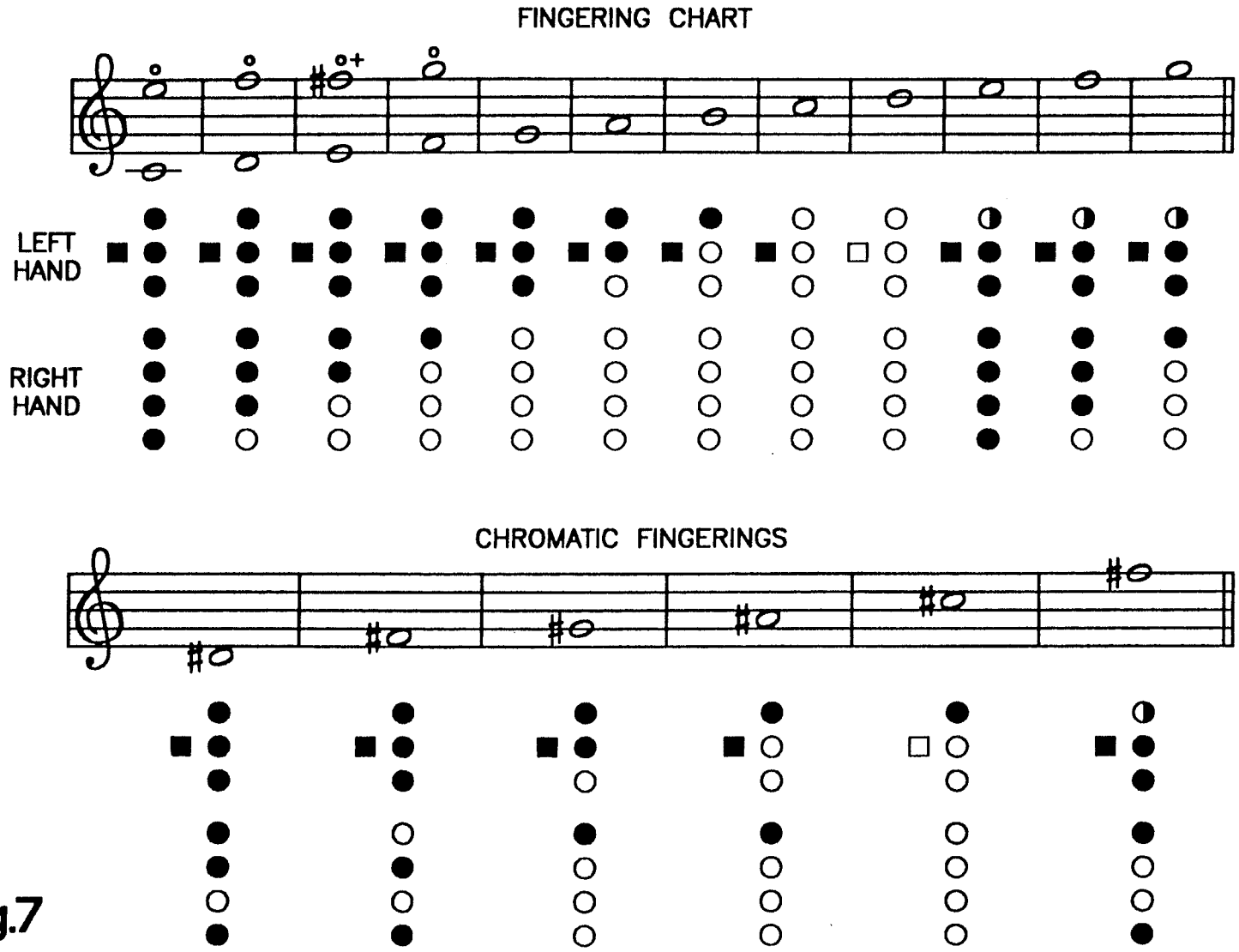
FIG. 7 is a fingering chart for the improved instrument of my invention; and, FIG. 8 is a fingering chart for the Flutophone$^R$, for comparison.

This invention, being a member of the family of woodwind instruments, is played, as are all woodwind instruments, by blowing into the mouthpiece end of the instrument, fipple head 10, and by covering or uncovering the finger holes in order to change the pitch. A fingering chart, FIG. 7, shows how finger holes are covered or uncovered in order to change the pitch. Three fingers and the thumb of the left hand and four fingers of the right hand are used. Black dots indicate covered holes and open rings indicate open holes. Half holes indicate partially covered holes. Venting holes partially in order to facilitate the production of harmonics is common practice in the playing of woodwinds. A music staff with a note above each fingering shows the pitch produced by that fingering combination. (The charts notate the pitch an octave lower, as is conventional also with the penny whistle and soprano recorder.

Figure 8:
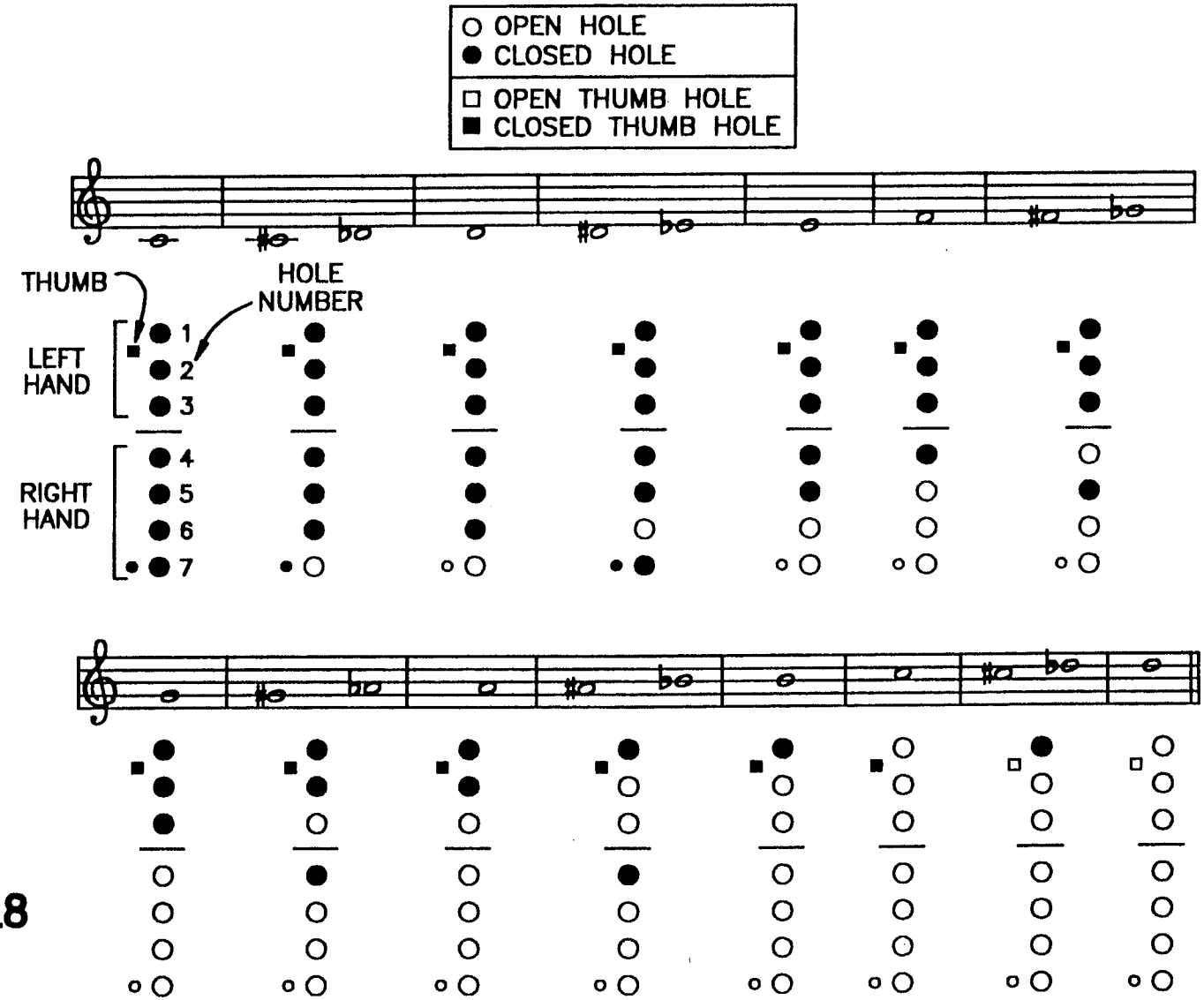

Another fingering chart, FIG. 8, shows the fingering patterns of the unmodified Flutophone$^R$ so that the linearity of the fingering patterns and the ranges of the two instruments, the Flutophone$^R$ and my invention the Flautino, can be compared.

One of the factors that complicates the designing of a musical instrument is that the instrument alone is not a musical entity, but a part of a system in which the other part of the system, namely the player, performs an important function, a function analogous to the voicing of a rank of organ pipes.

Pitch and tone quality are related and are to some extent controlled by the player. The physics of the instrument and the physiology of the player both were considered when making pitch measurements for my invention. It is obvious that skill and subjectivity are involved in creating pitch measurements of wind instruments. It is also obvious that the pitch aberrations of the Flutophone$^R$ are too great to be corrected by the performer. The fipple flute has far less flexibility for pitch correction than the orchestral flute. This is because on an orchestral flute, the air stream impinging upon the lip is shaped by both the embouchure hole and the player's lips, whereas on the fipple flute, the end of the windway is a physical part of the instrument, seen as 13 on FIG. 1, and therefore, the air stream may be modified only as to its velocity. Experiments were conducted both with children and professional musicians in developing my invention.

Pitch measurements were made with a twelve window Conn Stroboconn and are expressed in cents, each cent being 1/100 of a semitone. The pitch standard used is A-440. The pitches at the lower end of the Flutophone$^R$ range were at least 100 cents (one semitone) sharp for the lowest three tones on that instrument. They gradually improve until, for the G to A# in the middle range, they are on pitch. The four remaining high tones, B through D, vary widely, being respectively −12, +10, 0, and −10 cents off true pitch. In contrast, the Flautino of my invention can easily be blown on pitch for all the tones of the Flutophone$^R$ range except low C sharp, which tone it lacks, and it has the additional high tones E, F, F#, and G among which only the F (at +4 cents) is off true pitch. In the Flutophone$^R$, the corresponding fingerings for these new high tones do not produce usable notes, nor in fact can these pitches be reliably produced by that instrument.

These upper tones ($E^6$, $F^6$, F sharp $^6$, and $G^6$) are produced as "harmonics" of the lower notes $C^5$, $D^5$, $E^5$, and $F^5$. However, the acoustic means of their production is not exactly the same as in the ordinary woodwind instrument. It is well known that cylindrical and certain other bore shapes generate a regular harmonic series of frequencies comprising positive integral multiples of the fundamental. For example, if the fundamental frequency is called F, the air column in the bore of the flute can be split into two parts, separated by zero pressure nodes, resonating at the frequency 2F (the octave above F). Alternately, the column may be split into three parts, resonating at 3F (sounding the twelfth above F), and so on. In the penny whistle and other instruments, harmonics are directly employed for the higher register. One procures an upper register pitch by fingering a note which is a fundamental tone having the desired pitch in its regular harmonic series, and blowing with greater velocity to induce the air column to divide. (It also helps to open a tone hole, if one exists sufficiently close to a desired zero pressure node.) Thus, for example, one obtains an upper register scale on the penny whistle as a second harmonic by fingering the scale an exact octave lower and blowing harder than for the lower register scale. In the flute and some other instruments, the higher harmonics may also be involved in producing tones.

It has long been recognized that this system of extending the range depends on the bore's having the special property that, as tone holes are opened up, each fingering generates a regular harmonic series, so that the harmonics keep the same frequency ratio to their fundamentals. Indeed, the class of bore shapes having this property has been called the only "musically useful" (in Western music) class of wind instrument bores. That is, the harmonics of the bore are diatonic and chromatic tones in tune with the other scale tones produced by the instrument.

My invention is entirely contrary to the conventional teaching. It appears that "harmonics" are generated, for these tones arise in the same way as in the conventional instruments, that is, by fingering the lower tone ("fundamental") and blowing harder to produce the higher tone, thus presumably causing the air column to divide. However, it does not divide so as to produce a regular harmonic series, and, more importantly, it divides with a different frequency ratio for each different fundamental. Nevertheless, scale tones are generated because the tone $E^6$ is produced as a major tenth above $C^5$, the tone $F^6$ is produced as a minor tenth above $D^5$, the tone F sharp $^6$ as a sharp major ninth above E (corrected by alternate fingering), and the tone $G^6$ as a major ninth above $F^5$. To my knowledge, this is the only instrument which has achieved such a non-parallel series of harmonics in a musically useful way.

These harmonics might be considered rather to be regular harmonics, but they would then have to be harmonics of a shifted fundamental, and since the frequency ratios decrease as the harmonics move upwards, the "silent" fundamentals shift downwards.

While this invention has been described in detail with particular reference to the preferred embodiment thereof, it will be understood that other changes and modifications can be effected within the spirit and scope of the invention without deviating from the invention as hereinafter claimed.

I claim:

1. In an ocarina bore whistle flute comprising a fipple head and a globular bore having tone holes;

the improvement comprising fill means to reduce said bore in a bore region above said tone holes to values lying in the range of 0–7" to 0.8", said fill means improving the intonation of at least one tone of said ocarina bore whistle flute.

2. The improvement of claim 1 and in which said reduction adds at least one tone to the useful range of said ocarina bore whistle flute.

3. The improvement of claim 1 and in which said reduction reduces said bore in a first bore region in said fipple head and reduces said bore in a second bore region below said fipple head.

4. In an ocarina bore whistle flute comprising a fipple head, a globular bore having tone holes and having a small end, a chromatic tone hole, a bell flare, and a web separating said small end of said globular bore from said bell flare, said web having a web hole therein, the improvement comprising a web insert having a web insert hole therein, said web insert being located adjacent to said web, whereby said web hole is extended, by the thickness of said web insert, to at least twice its original depth, and fill means for eliminating said chromatic tone hole.

5. The improvement of claim 4 and in which said web insert hole has the shape of a truncated cone.

6. In a wind instrument bore having at least a first and a second tone hole, and producing musical tones, the improvement comprising modifying the diameter of said bore in at least a first and a second place such that a second harmonic can be produced when said first tone hole is open, and said second tone hole is closed, which lies at a different interval above its fundamental than does a second harmonic which can be produced when both said first and second tone holes are open, but said second harmonics are diatonic or chromatic tones in tune with the other tones produced by said bore.

* * * * *